US009435346B2

(12) United States Patent
Osuka et al.

(10) Patent No.: US 9,435,346 B2
(45) Date of Patent: Sep. 6, 2016

(54) COMPRESSOR HOUSING FOR SUPERCHARGER AND METHOD FOR MANUFACTURING THE SAME

(75) Inventors: Ryu Osuka, Aichi (JP); Hiroki Matsui, Aichi (JP); Tomoyuki Isogai, Aichi (JP)

(73) Assignees: OTICS Corporation, Nishio (JP); TOYOTA JIDOSHA KABUSHIKI KAISHA, Toyota-shi (JP)

( * ) Notice: Subject to any disclaimer, the term of this patent is extended or adjusted under 35 U.S.C. 154(b) by 846 days.

(21) Appl. No.: 13/642,934

(22) PCT Filed: Mar. 30, 2011

(86) PCT No.: PCT/JP2011/057968

§ 371 (c)(1),
(2), (4) Date: Oct. 23, 2012

(87) PCT Pub. No.: WO2011/132509

PCT Pub. Date: Oct. 27, 2011

(65) Prior Publication Data

US 2013/0039750 A1 Feb. 14, 2013

(30) Foreign Application Priority Data

Apr. 23, 2010 (JP) ..... 2010-099711

(51) Int. Cl.
*F02B 39/00* (2006.01)
*F04D 29/02* (2006.01)
(Continued)

(52) U.S. Cl.
CPC ..... *F04D 29/023* (2013.01); *B22C 9/24* (2013.01); *B22D 17/00* (2013.01);
(Continued)

(58) Field of Classification Search
CPC .... F04D 17/10; F04D 29/002; F04D 29/023; F04D 29/403; F04D 29/4213; F04D 29/601; F05D 2210/42; F05D 2220/40; F05D 2250/14; F05D 2260/37; B22C 9/24; B22D 17/00; Y10T 29/49243
USPC ..... 415/196–197, 204, 206, 912, 914
See application file for complete search history.

(56) References Cited

U.S. PATENT DOCUMENTS

| | | | | |
|---|---|---|---|---|
| 5,246,352 | A * | 9/1993 | Kawakami | 417/407 |
| 6,193,463 | B1 * | 2/2001 | Adeff | F04D 29/023 415/196 |
| 7,179,051 | B2 * | 2/2007 | Williams et al. | 415/204 |
| 2006/0110249 | A1 | 5/2006 | Williams et al. | |

FOREIGN PATENT DOCUMENTS

| | | |
|---|---|---|
| DE | 102 60 042 A1 | 7/2004 |
| EP | 1 192 360 | 4/2002 |

(Continued)

OTHER PUBLICATIONS

International Search Report Issued Jun. 7, 2011 in PCT/JP11/57968 Filed Mar. 30, 2011.
Extended European Search Report issued Dec. 9, 2015 in Patent Application No. 11771846.0.

*Primary Examiner* — Craig Kim
*Assistant Examiner* — Alexander White
(74) *Attorney, Agent, or Firm* — Oblon, McClelland, Maier & Neustadt, L.L.P

(57) ABSTRACT

In a compressor housing, a scroll piece includes a cylindrical intake port forming section, a scroll wall surface forming section that forms an air-intake side wall surface of a discharge scroll chamber, and a scroll outer circumferential section that covers an outer circumferential side of the discharge scroll chamber. A shroud piece of the housing includes a cylindrical shroud press fitted section press fitted into the intake port forming section, and a shroud wall surface forming section that forms an inner circumferential side wall surface of the discharge scroll chamber and also forms a shroud surface that opposes an impeller and a diffuser surface. An outer circumferential annular piece of the housing includes an outer circumferential annular press fitted section press fitted inside the scroll outer circumferential section, and an outer circumferential annular wall surface forming section that forms an outer circumferential side wall surface of the discharge scroll chamber.

6 Claims, 8 Drawing Sheets

(51) Int. Cl.

| | |
|---|---|
| ***B22C 9/24*** | (2006.01) |
| ***B22D 17/00*** | (2006.01) |
| ***F04D 29/42*** | (2006.01) |
| ***F04D 29/44*** | (2006.01) |
| ***F04D 29/62*** | (2006.01) |
| *B23P 17/00* | (2006.01) |

(52) U.S. Cl.
CPC ..... *F04D 29/4206* (2013.01); *F04D 29/441* (2013.01); *F04D 29/624* (2013.01); *F05D 2220/40* (2013.01); *F05D 2230/21* (2013.01); *F05D 2250/52* (2013.01); *F05D 2260/37* (2013.01); *Y10T 29/49243* (2015.01)

(56) References Cited

FOREIGN PATENT DOCUMENTS

| | | |
|---|---|---|
| JP | 3153378 | 4/2001 |
| JP | 2002 180841 | 6/2002 |
| WO | 01 00996 | 1/2001 |
| WO | WO 2004/005674 A1 | 1/2004 |
| WO | WO 2007/018529 A1 | 2/2007 |

* cited by examiner

COMPRESSOR HOUSING FOR SUPERCHARGER AND METHOD FOR MANUFACTURING THE SAME

TECHNICAL FIELD

The present invention relates to a compressor housing for a supercharger configured to house an impeller including a plurality of blades, and a method of manufacturing the same.

BACKGROUND ART

A compressor (compression machine) used in a supercharger such as a turbocharger of an automobile includes a compressor housing configured to house an impeller that includes a plurality of blades.

The compressor housing includes an intake port that takes in air toward the impeller, a discharge scroll chamber that is formed in a circumferential direction at an outer circumference of the impeller and guides air discharged from the impeller to outside, and other than the above, a portion to house the impeller, a diffuser section and the like.

As a method of manufacturing a compressor housing, for example, there is a method to form the same by gravity casting. In this case, since the casting can be performed by using a so-called core, the degree of freedom for shape formation is high to cope with a complicated shape. However, productivity is low due to a long casting cycle, and also, cost therefor is high.

On the other hand, there is a method to form a compressor housing by die casting. In this case, compared to the gravity casting, the productivity is satisfactory and the cost therefor is low due to short casting cycle. However, the method is available only when it is designed to be formed by die cutting. The degree of freedom for shape formation is low, thus failing to cope with a complicated shape. Due to this, even if the shape can be formed by the gravity casting, there may be cases in which such shape (especially, shapes of wall surfaces of a discharge scroll chamber that may influence a compressor performance) cannot be reproduced by the die casting.

Thus, as shown in FIG. 7, a technique that configures a compressor housing 91 by dividing the same into two components, namely a scroll piece 92 and a shroud piece 93, forms these components by die casting, and assembles the same has been proposed (see patent document 1). In this compressor housing 91, a wall surface forming section 962 that forms a part of an outer circumferential side wall surface of a discharge scroll chamber 912 (outer circumferential wall surface 913) is provided in a back plate 961 opposing a diffuser surface 931 of the shroud piece 93, whereby the wall surface of the discharge scroll chamber 912 is formed of the scroll piece 92, the shroud piece 93, and this wall surface forming section 962.

RELATED ART DOCUMENT

Patent Document

Patent Document 1: Japanese Unexamined Patent Application Publication No. 2002-180841

SUMMARY OF INVENTION

Problem to be Solved by the Invention

However, in the compressor housing 91 shown in FIG. 7, processing is performed on the back plate 961 by using a lathe and the like, to provide the wall surface forming section 962 including the outer circumferential wall surface 913 of the discharge scroll chamber 912. Due to this, a shape of the outer circumferential wall surface 913 of the discharge scroll chamber 912 can only be processed into a simple, axially symmetric shape. Thus, the complicated shape with axial asymmetry, which can be formed by the gravity casting cannot be dealt with, thus failing to ensure desired performance. Further, even if other processing methods are used, productivity as a whole is degraded, and cost becomes high. Due to this, an advantage of the die casting of satisfactory productivity and low cost cannot be utilized.

The present invention has been made in view of the foregoing conventional problem, and aims to provide a compressor housing for a supercharger having superior productivity and capable of improving its performance, and a method of manufacturing the same.

Means for Solving the Problem

A first invention is a compressor housing for a supercharger, which is configured to house an impeller with a plurality of blades, and includes an intake port that takes in air toward the impeller, and a discharge scroll chamber that is formed in a circumferential direction at an outer circumferential side of the impeller, and that guides the air discharged from the impeller to outside. The compressor housing includes a scroll piece including a cylindrical intake port forming section that forms the intake port, a scroll wall surface forming section that forms an air-intake side wall surface of the discharge scroll chamber, and a scroll outer circumferential section that covers an outer circumferential side of the discharge scroll chamber, a shroud piece including a cylindrical shroud press fitted section that is press fitted into the intake port forming section of the scroll piece, and a shroud wall surface forming section that forms an inner circumferential side wall surface of the discharge scroll chamber, and that forms a shroud surface opposing the impeller and a diffuser surface that extends from the shroud surface toward the discharge scroll chamber, and an outer circumferential annular piece including an outer circumferential annular press fitted section that is press fitted into the scroll outer circumferential section of the scroll piece, and an outer circumferential annular wall surface forming section that forms an outer circumferential side wall surface of the discharge scroll chamber.

A second invention is a method of manufacturing the compressor housing for a supercharger according to the first invention, which includes a forming step of forming the scroll piece and an integral piece that integrally includes parts that are to be the shroud piece and the outer circumferential annular piece by die casting, respectively, a press-fitting step of press fitting the shroud press fitted section that constitutes a part of the integral piece into the intake port forming section of the scroll piece, and press fitting the outer circumferential annular press fitted section that constitutes a part of the integral piece into the scroll outer circumferential section of the scroll piece, and a cutting and separating step of cutting the integral piece subsequent to the press-fitting step, and separating the integral piece into the shroud piece and the outer circumferential annular piece.

Effects of the Invention

The compressor housing of the first invention consists of three components, namely, the scroll piece, the shroud piece, and the outer circumferential annular piece. That is, the wall surface of the discharge scroll chamber is made up of the three components. Unlike the related art, it is no longer necessary to process a back plate opposing the diffuser surface of the shroud wall surface forming section in the shroud piece so as to form a part of the wall surface of the discharge scroll chamber. This makes it possible to improve productivity.

Further, since the compressor housing consists of the three components, each component is designed to have a simple shape that can be formed by die cutting. The formation can be performed by die casting with high productivity and low cost. The resultant productivity can be improved while suppressing the cost.

Further, as will be described later, when performing the formation by die casting, a surface roughness of a formed product can be made small, and the compressor performance can be improved.

In the forming step of the method of manufacturing the compressor housing according to the second invention, two components, namely the scroll piece, and an integral piece integrally including the parts that are to be the shroud piece and the outer circumferential annular piece, are formed by die casting. Due to this, unlike the method that separately forms three components, namely the scroll piece, the shroud piece, and the outer circumferential annular piece, this method can improve the productivity while suppressing the cost of the formation.

Further, in the press-fitting step, the integral piece is press fitted into the scroll piece, and in the subsequent cutting and separating step, the integral piece is cut into the shroud piece and the outer circumferential annular piece. That is, the integral piece is separated into the two components, namely the shroud piece and the outer circumferential annular piece, after assembling the two components, namely the scroll piece and the integral piece, and as a result, the compressor housing that consists of the three components is obtained. Thus, unlike the method of separately assembling the three components, the present method allows easy assembly as well as improved productivity.

Further, the compressor housing that is obtained by the manufacturing method as described above consists of the three components, namely the scroll piece, the shroud piece and the outer circumferential annular piece. Specifically, the wall surface of the discharge scroll chamber is made up of the three components. Unlike the conventional method, it is no longer necessary to process the back plate so as to form a part of the wall surface of the discharge scroll chamber, which makes it possible to improve productivity.

Further, in the manufacturing method as described above, since the forming is performed by die casting, a surface roughness of a formed product can be reduced compared to the method of forming by gravity casting and the like. This may reduce the surface roughness of the wall surface of the discharge scroll chamber as a portion where air discharged from the impeller is brought into contact when it is introduced into the discharge scroll chamber, which may affect the compressor performance. The method, thus achieves improvement in the compressor performance.

As described above, according to the present invention provides the compressor housing for the supercharger and the method of manufacturing the same with superior productivity and capable of achieving improvements in the performance.

Figure 1:
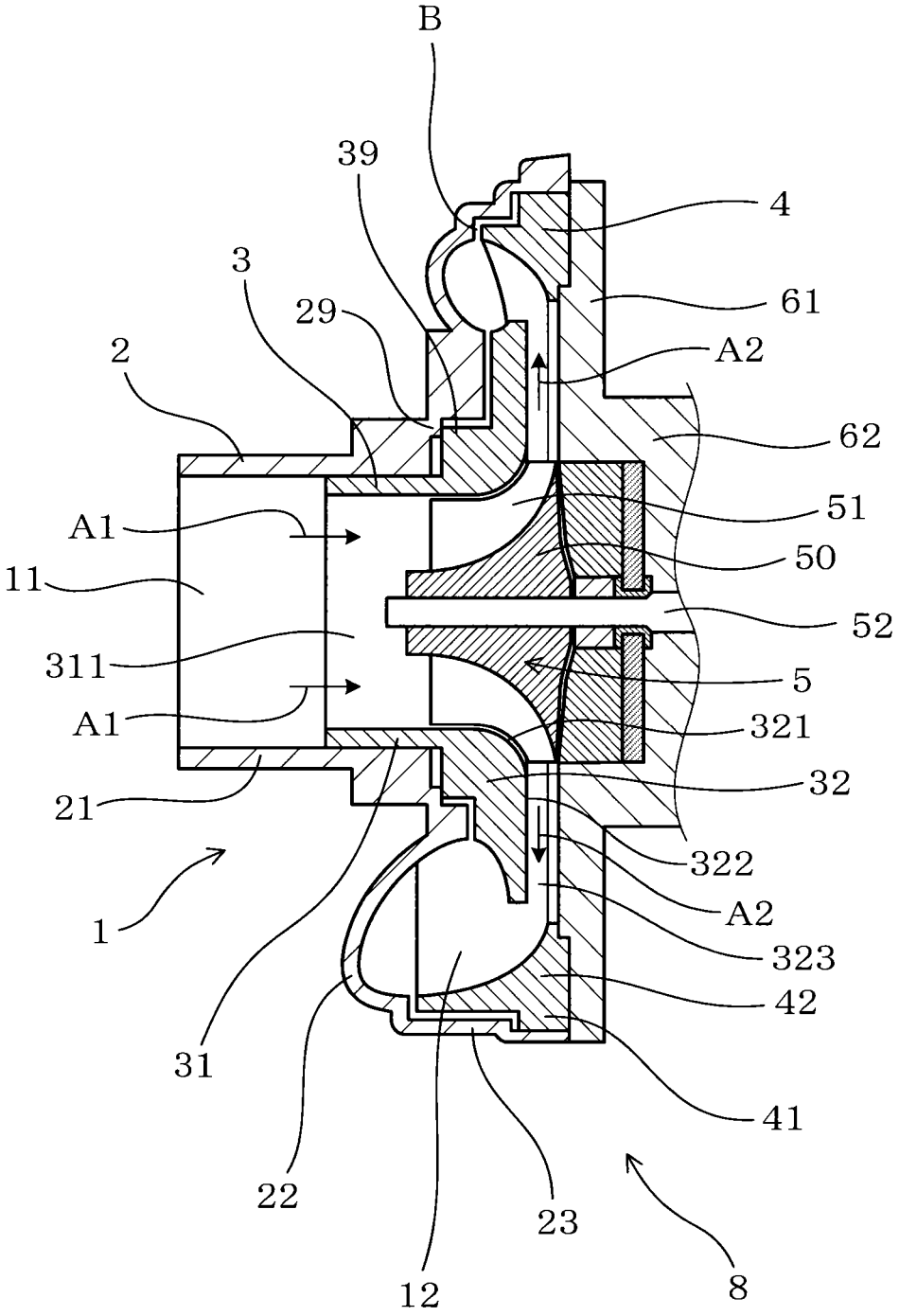
FIG. 1 is a cross sectional view of an embodiment showing structures of a compressor housing and its periphery.

In the first invention, the shroud piece preferably includes a positioning section that makes contact in an axial direction with a contacting section of the scroll piece.

In this case, the shroud piece in the axial direction can be accurately positioned. This makes it possible to reduce or eliminate the gap between the shroud piece and the scroll piece, and to improve the compressor performance.

Further preferably, the compressor housing is used in the supercharger in which a back plate opposing the diffuser surface of the shroud wall surface forming section of the shroud piece and a bearing housing that axially supports a rotation shaft of the impeller are integrally formed.

Here, the back plate and the bearing housing are integrally formed by sand mold casting and the like. The resultant casting surface of the back plate becomes rough, which is not desirable aerodynamically. For this reason, the back plate has to be subjected to a machining process. However, in the compressor housing of the present invention, as there is no need to process the back plate so as to form a part of the wall surface of the discharge scroll chamber as in the conventional technique, the surface of the back plate can be formed as a flat surface. Thus, the back plate can be easily subjected to the machining process.

The back plate and the bearing housing may be configured as separate components.

According to the second invention, preferably in the press-fitting step, a press-fitting fastening margin between the scroll outer circumferential section of the scroll piece and the outer circumferential annular press fitted section that constitutes the part of the integral piece is made smaller than a press-fitting fastening margin between the intake port forming section of the scroll piece and the shroud press fitted section that constitutes the part of the integral piece.

In this case, the press-fitting operation of the integral piece into the scroll piece can easily be performed. Further, displacement in coaxial arrangement between the shroud press fitted section and the outer circumferential annular press fitted section can thereby be suppressed.

Further preferably, in the press-fitting step, a positioning section formed in the part of the integral piece, which is to be the shroud piece is brought into contact in an axial direction with a contacting section formed in the scroll piece.

In this case, the axial direction press-fitting position of the integral piece can be determined accurately. That is, a final positioning of the shroud piece in the axial direction can be performed accurately. This makes it possible to accurately form the gap between the diffuser surface and the back plate (the aforementioned diffuser section), and to improve the compressor performance.

Further, in the press-fitting step, the gap is preferably formed between the part in the integral piece that is to be the outer circumferential annular piece and the scroll piece in the axial direction without contacting those pieces with each other.

In this case, the positioning section that is formed at the part in the integral piece that is to be the shroud piece can surely be brought into contact with the contacting section of the scroll piece upon press fitting of the integral piece. This makes it possible to have the axial direction press-fitting position of the integral piece positioned more accurately. That is, the final positioning of the shroud piece in the axial direction can be performed more accurately.

Further, the positioning of the outer circumferential annular piece in the axial direction can be performed accurately by cutting the integral piece after the press-fitting step and press fitting the outer circumferential annular piece into the scroll piece again in the axial direction until they are in contact with each other.

Embodiment

A compressor housing for a supercharger and a method of manufacturing the same according to an embodiment of the present invention will be described with reference to the drawings.

As shown in FIG. 1, a compressor housing 1 of the embodiment forms an outer shell of a compressor (compression machine) 8 used for a turbocharger (supercharger) of an automobile, is configured to house an impeller 5 that includes a plurality of blades 51, and includes an intake port 11 that takes in air A1 toward the impeller 5, and a discharge scroll chamber 12 formed along a circumferential direction on an outer circumferential side of the impeller 5 and that guides air A2 discharged from the impeller 5 to outside.

Figure 2:
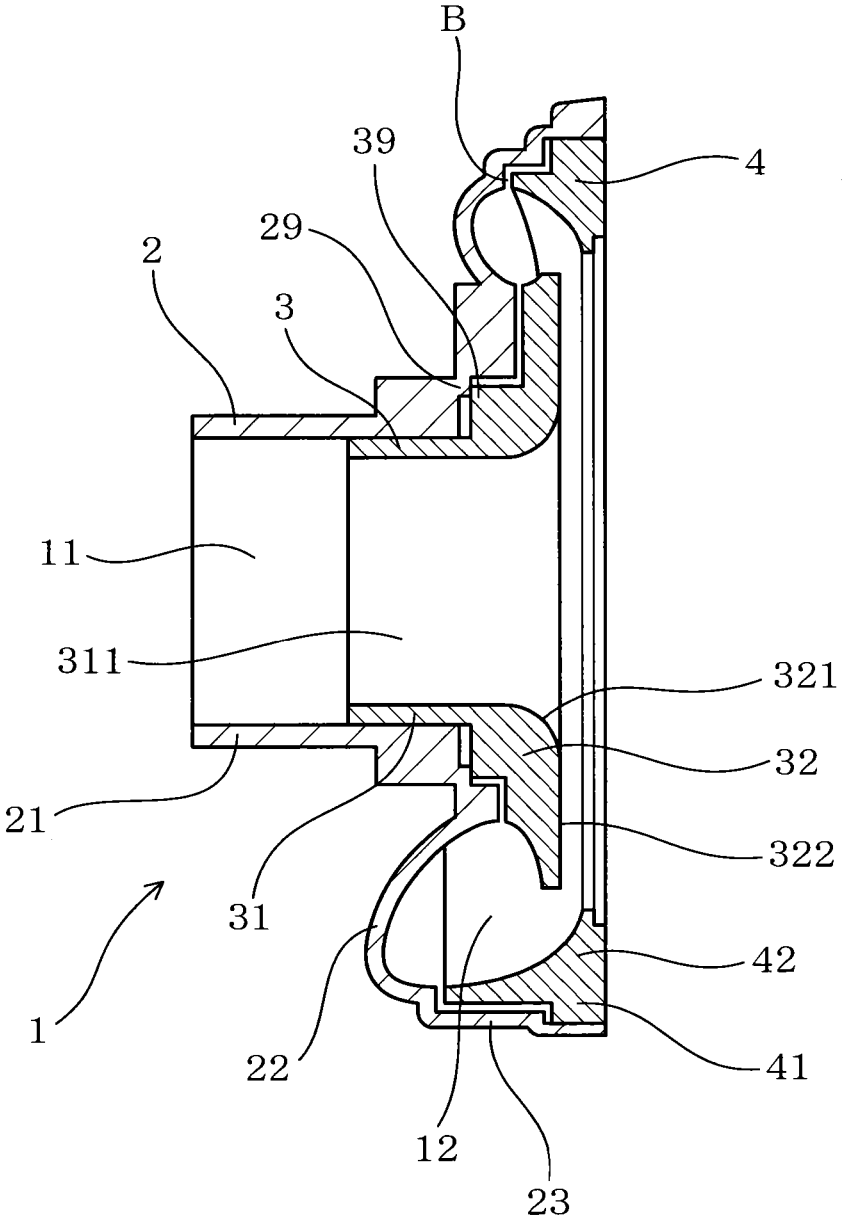
FIG. 2 is a cross sectional view of the embodiment showing the structure of the compressor housing.

As shown in FIG. 1 and FIG. 2, the compressor housing 1 consists of three components, namely, a scroll piece 2, a shroud piece 3, and an outer circumferential annular piece 4. Specifically, the shroud piece 3 and the outer circumferential annular piece 4 are assembled in the scroll piece 2.

The three components that constitute the compressor housing 1 are all formed as die cast products which are made of aluminum. As a material for forming the respective components, for example, resin and the like may be used instead of aluminum.

As shown in the drawings, the scroll piece 2 includes a cylindrical intake port forming section 21 that forms the intake port 11, a scroll wall surface forming section 22 that forms an air-intake side wall surface of the discharge scroll chamber 12, and a scroll outer circumferential section 23 that covers the outer circumferential side of the discharge scroll chamber 12.

Further, at a bottom portion of the intake port forming section 21 of the scroll piece 2, a contacting section 29 that allows the shroud piece 3 to be in contact therewith in an axial direction is formed.

As shown in the drawings, the shroud piece 3 includes a cylindrical shroud press fitted section 31 that is press fitted into the intake port forming section 21 of the scroll piece 2, and a shroud wall surface forming section 32 that forms an inner circumferential side wall surface of the discharge scroll chamber 12, and that at the same time forms a shroud surface 321 opposing the impeller 5 and a diffuser surface 322 that extends from the shroud surface 321 toward the discharge scroll chamber 12.

As shown in the drawings, an air intaking passage 311 that communicates with the intake port 11 is formed inside the shroud press fitted section 31 of the shroud piece 3.

Further, a positioning section 39 for positioning of the shroud piece 3 in the axial direction is formed at a connecting portion between the shroud press fitted section 31 and the shroud wall surface forming section 32 of the shroud piece 3. The shroud piece 3 causes the positioning section 39 to be in contact with the contacting section 29 of the scroll piece 2 in the axial direction.

As shown in the drawings, the outer circumferential annular piece 4 includes an outer circumferential annular press fitted section 41 that is press fitted inside the scroll outer circumferential section 23 of the scroll piece 2, and an outer circumferential annular wall surface forming section 42 that forms an outer circumferential side wall surface of the discharge scroll chamber 12.

Further, the outer circumferential annular piece 4 is not in contact with the scroll piece 2 in the axial direction so that a gap B is formed therebetween. Note that the outer circumferential annular piece 4 may be configured to be press fitted until it makes contact with the scroll piece 2 of the axial direction.

Further, as shown in FIG. 1, the impeller 5 is arranged at an inner circumferential side of the shroud piece 3. The impeller 5 is formed by providing a hub 50 with the plurality of blades 51 which are protruding therefrom and aligned in the circumferential direction on an outer circumferential surface thereof. The plurality of blades 51 are arranged to oppose the shroud surface 321 of the shroud wall surface forming section 32 of the shroud piece 3.

Further, as shown in the drawing, a back plate 61 that covers a side of the compressor housing 1 opposite the air intake side is provided at a position that opposes the diffuser surface 322 of the shroud wall surface forming section 32 of the shroud piece 3. The back plate 61 is formed integrally with a bearing housing 62 that axially supports a rotation shaft 52 of the impeller 5.

Further, a diffuser section 323 that pressurizes the air A2 discharged from the impeller 5 is formed between the diffuser surface 322 of the shroud wall surface forming section 32 of the shroud piece 3 and the back plate 61.

Further, as shown in the drawing, the compressor 8 is configured such that the air A1 is taken into the impeller 5 from the intake port 11 via the air intake passage 311 by rotation of the impeller 5, and the air A2 accelerated by the blades 51 of the impeller 5 is pressurized in the diffuser section 323, and is sent into the discharge scroll chamber 12.

Next, a method of manufacturing the compressor housing 1 of the embodiment will be explained.

Figure 3:
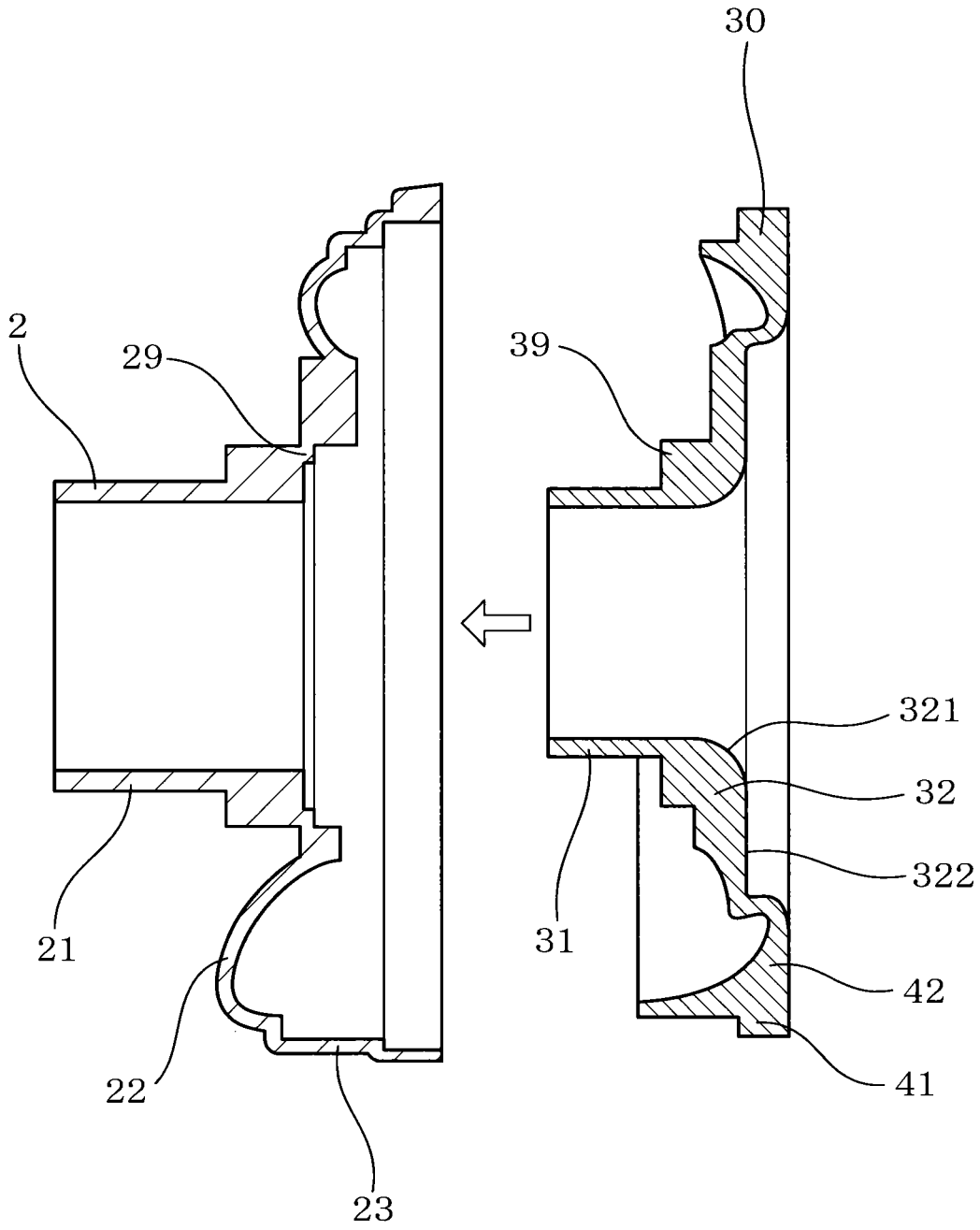
FIG. 3 is an explanatory view of the embodiment showing a scroll piece and an integral piece that are formed.
Figure 4:
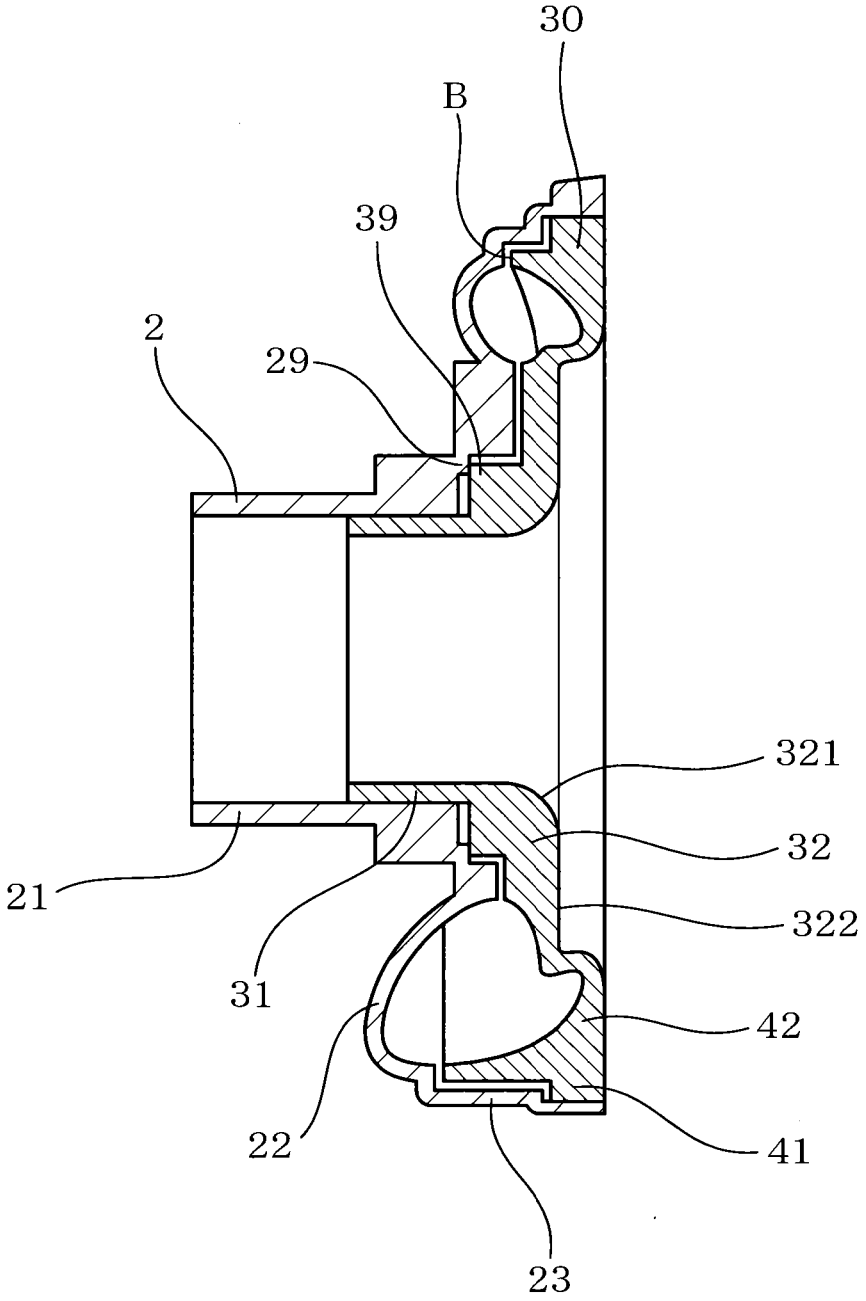
FIG. 4 is an explanatory view of the embodiment showing a state in which the integral piece is press fitted into the scroll piece.
Figure 5:
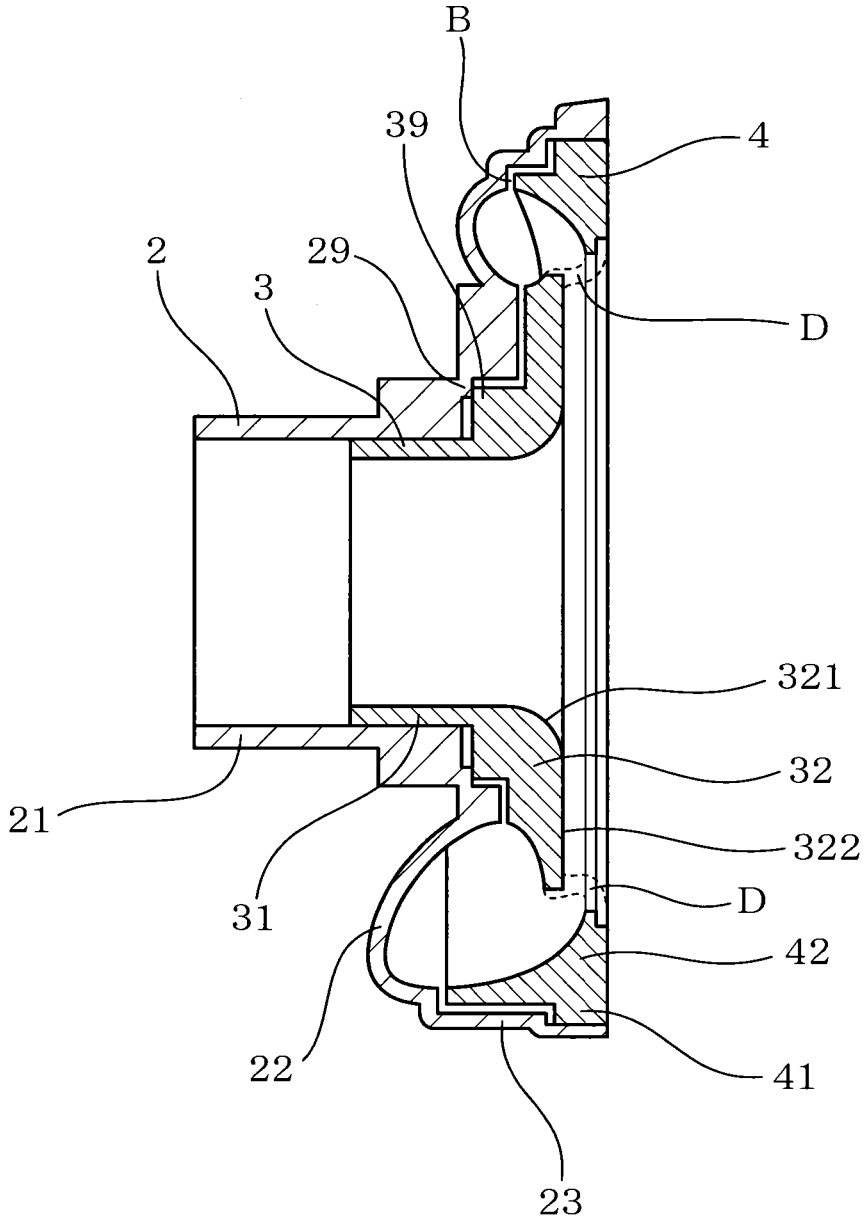
FIG. 5 is an explanatory view of the embodiment showing a state in which the integral piece is cut into a shroud piece and an outer circumferential annular piece.

As shown in FIG. 3 to FIG. 5, the method of manufacturing the compressor housing 1 of the embodiment performs a forming step of respectively forming the scroll piece 2 and an integral piece 30 including parts that are to be the shroud piece 3 and the outer circumferential annular piece 4 by die casting, a press-fitting step of press fitting the shroud press fitted section 31 that partially forms the integral piece 30 into the intake port forming section 21 of the scroll piece 2, and press fitting the outer circumferential annular press fitted section 41 that partially forms the integral piece 30 into the scroll outer circumferential section 23 of the scroll piece 2, and a cutting and separating step of cutting the integral piece 30 after the press-fitting step so as to be separated into the shroud piece 3 and the outer circumferential annular piece 4.

They will be described in detail as below.

In manufacturing the compressor housing 1, firstly, as shown in FIG. 3, the scroll piece 2 is formed by die casting. Then, the integral piece 30 integrally including the parts that are to be the shroud piece 3 and the outer circumferential annular piece 4 is formed by die casting as well.

Then, as shown in FIG. 4, the integral piece 30 is press fitted into the scroll piece 2 in the axial direction. Specifically, the shroud press fitted section 31 that constitutes the part of the integral piece 30 is press fitted into the intake port forming section 21 of the scroll piece 2, and at the same time the outer circumferential annular press fitted section 41 that constitutes the part of the integral piece 30 is press fitted into the scroll outer circumferential section 23.

Figure 8:
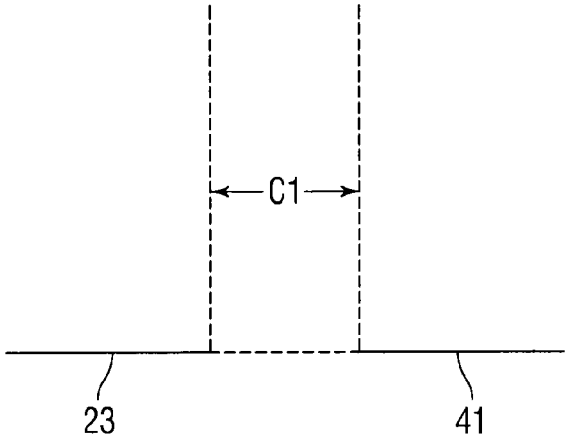
FIG. 8 is a close-up, schematic view of a press-fitting fastening margin of a scroll outer circumferential section and an outer circumferential annular press fitted section.
Figure 9:
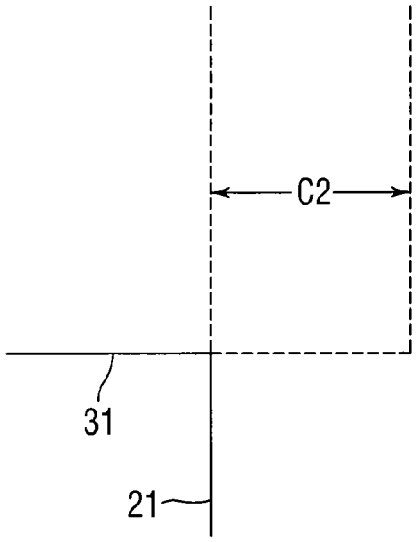
FIG. 9 is a close-up, schematic view of a press-fitting fastening margin of an intake port forming section and a shroud press fitted section.

At this time, a press-fitting fastening margin C1 (FIG. 8) of the scroll outer circumferential section 23 and the outer circumferential annular press fitted section 41 is made smaller than a press-fitting fastening margin C2 (FIG. 9) of the intake port forming section 21 and the shroud press fitted section 31. For example, the press-fitting fastening margin C1 (FIG. 8) is set to be 40 to 100 μm, and the press-fitting fastening margin C2 (FIG. 9) is set to be 100 to 150 μm.

Then, as shown in the drawing, the positioning section 39 formed at the part of the integral piece 30, which is to be the shroud piece 3 is caused to make contact with the contacting section 29 formed in the scroll piece 2 in the axial direction. Positioning of the integral piece 30 in the axial direction is performed thereby, and the press fitting of the integral piece 30 is completed.

Then, as shown in FIG. 5, the integral piece 30 is cut by machining. Specifically, an annular connecting portion D between the shroud wall surface forming section 32 and the outer circumferential annular wall surface forming section 42 is cut by machining. As a result, the integral piece 30 is separated into the shroud piece 3 and the outer circumferential annular piece 4, and a predetermined gap is formed between these components.

According to the above, the compressor housing 1 shown in FIG. 1 and FIG. 2 is obtained.

Next, working and advantageous effects of the compressor housing 1 and the method of manufacturing the same of the embodiment will be described.

In the method of manufacturing the compressor housing 1 of the embodiment, in the forming step, two components, namely, the scroll piece 2 and the integral piece 30 that integrally includes the parts that are to be the shroud piece 3 and the outer circumferential annular piece 4, are formed by die casting. In this way, compared to a case of separately forming three components, namely the scroll piece 2, the shroud piece 3 and the outer circumferential annular piece 4, productivity can be improved while suppressing cost of the formation.

Further, in the press-fitting step, the integral piece 30 is press fitted into the scroll piece 2, and in the subsequent cutting and separating step, the integral piece 30 is cut and separated into the shroud piece 3 and the outer circumferential annular piece 4. That is, the integral piece 30 is separated into two components, namely the shroud piece 3 and the outer circumferential annular piece 4, after having assembled the two components, namely the scroll piece 2 and the integral piece 30, and as a result thereof, the compressor housing 1 consisted of the three components is obtained. Thus, compared to the case of separately assembling the three components, the assembly can be performed easily, thus improving the productivity.

Further, the compressor housing 1 that is obtained by the manufacturing method of the present embodiment consists of the three components, namely the scroll piece 2, the shroud piece 3 and the outer circumferential annular piece 4. That is, the wall surface of the discharge scroll chamber 12 is made up of the three components. This may eliminate the need of forming a part, it no longer becomes necessary to process the back plate 61 so as to form a part of the wall surface of the discharge scroll chamber 12 by processing the back plate 61 as in the conventional technique, thus improving productivity.

Further, in the manufacturing method of the embodiment, since the forming is performed by die casting, a surface roughness of a formed product can be made small compared to a case of forming by gravity casting. Due to this, the surface roughness of the wall surface of the discharge scroll chamber 12, which is a portion where the air A2 discharged from the impeller 5 makes contact upon being introduced into the discharge scroll chamber 12 and that affects the performance of the compressor 8, can be made small. This may achieve improvement in performance of the compressor 8.

Further, in the embodiment, the compressor housing 1 is used in a turbocharger (supercharger) having the back plate 61 and the bearing housing 62 formed integrally. Here, in the case of integrally forming the back plate 61 and the bearing housing 62, they are integrally formed by sand mold casting and the like. For this, a casting surface of the back plate 61 becomes rough, which is not desirable in the aspect of aerodynamics, and requires the back plate 61 to be subjected to machining process. However, in the compressor housing 1 of the embodiment, since there is no need to process the back plate 61 for formation of a part of the wall surface of the discharge scroll chamber 12 as in the conventional technique, the surface of the back plate 61 can be formed as a flat surface. Thus, the machining process applied to the back plate 61 can easily be performed.

Further, in the press-fitting step, the press-fitting fastening margin C1 (FIG. 8) of the scroll outer circumferential section 23 and the outer circumferential annular press fitted section 41 is made smaller than the press-fitting fastening margin C2 (FIG. 9) of the intake port forming section 21 and the shroud press fitted section 31. This makes it possible to allow easy performance of the press-fitting operation of the integral piece 30 into the scroll piece 2. This may suppress the coaxial displacement between the shroud press fitted section 31 and the outer circumferential annular press fitted section 41.

Further, in the press-fitting step, the positioning section 39 formed at the part of the integral piece 30, which is to be the shroud piece 3 is brought into contact with the contacting section 29 formed in the scroll piece 2 in the axial direction. This ensures to determine an axial direction press-fitting position of the integral piece 30 accurately. That is, a final positioning of the shroud piece 3 in the axial direction can be performed further accurately. This makes it possible to form the diffuser section 323 accurately, and improve performance of the compressor 8.

Further, in the press-fitting step, the gap B is formed without bringing the part of the integral piece 30, which is to be the outer circumferential annular piece 4 into contact with the scroll piece 2 in the axial direction. As a result, the positioning section 39 formed at the part of the integral piece 30, which is to be the shroud piece 3 may be brought into contact with the contacting section 29 of the scroll piece 2 upon press fitting of the integral piece 30. This may determine the axial direction press-fitting position of the integral piece 30 more accurately. That is, the final positioning of the shroud piece 3 in the axial direction can be performed further accurately.

Positioning of the outer circumferential annular piece 4 in the axial direction can be performed accurately by cutting the integral piece 30 after the press-fitting step, and press fitting the outer circumferential annular piece 4 into the scroll piece 2 until the axial contact therebetween is made.

As described above, according to the embodiment, the compressor housing 1 for the supercharger and the method of manufacturing the same with superior productivity and improved performance may be provided.

Figure 6:
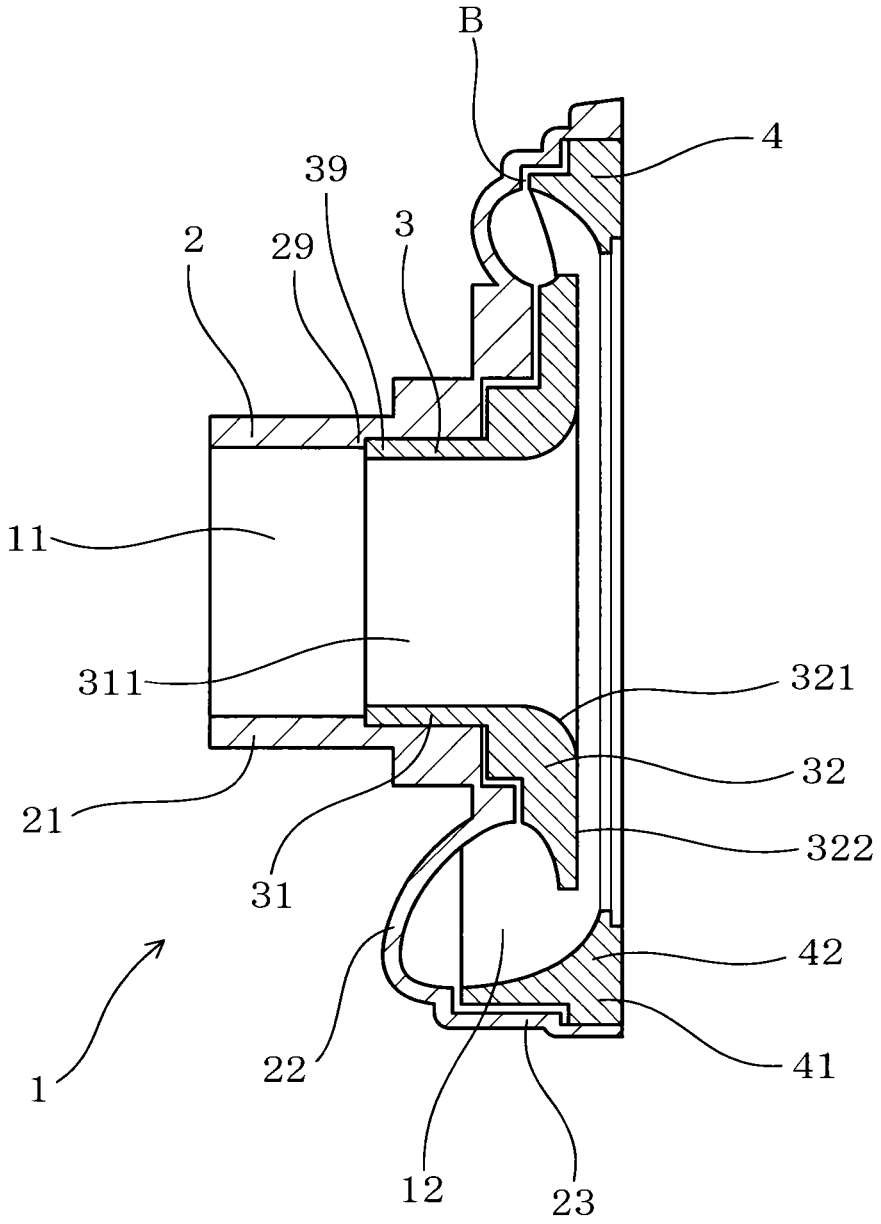
FIG. 6 is a cross sectional view of the embodiment showing the structure of the compressor housing having a position of a contacting section changed.
Figure 7:
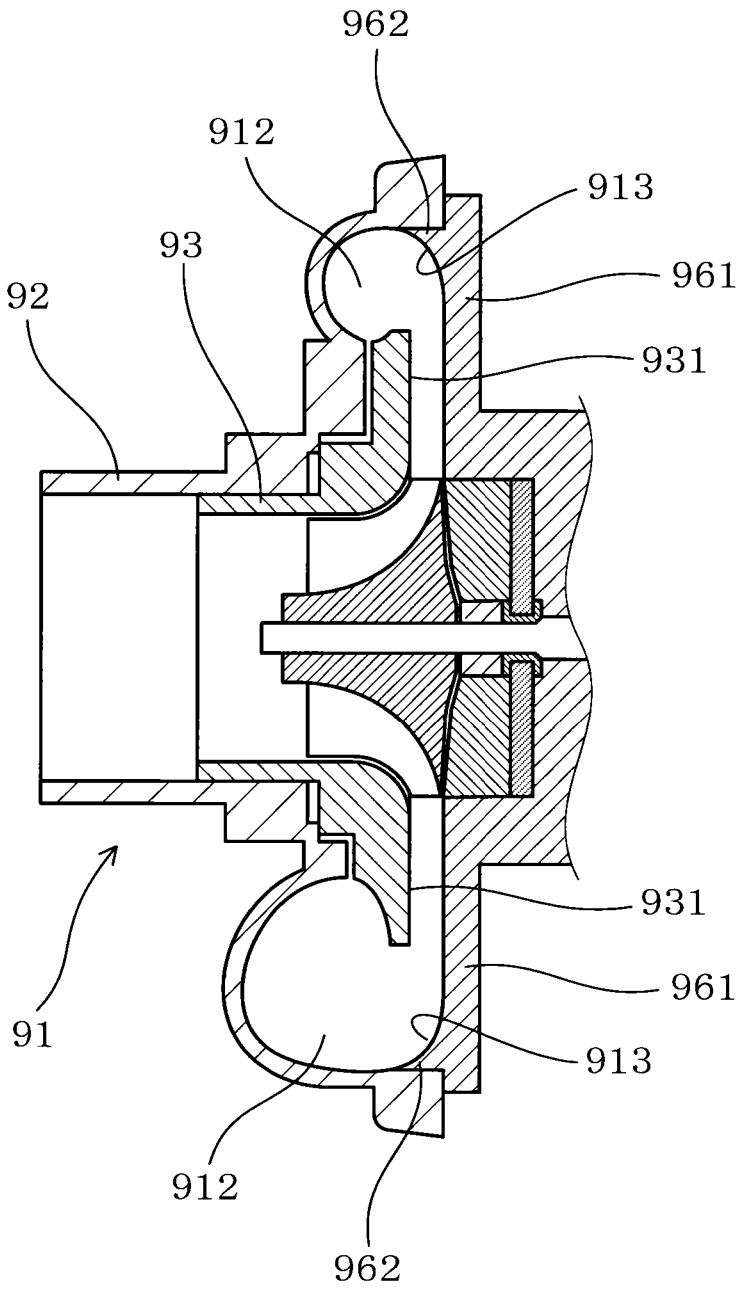
FIG. 7 is a cross sectional view of related art showing structures of a compressor housing and its periphery.

The embodiment, as shown in FIG. 2, is configured to bring the positioning section 39 formed at the connecting portion between the shroud press fitted section 31 of the shroud piece 3 and the shroud wall surface forming section 32 into contact with the contacting section 29 formed at the bottom portion of the intake port forming section 21 of the scroll piece 2. It may for example be configured to form the contacting section 29 at an axial direction intermediate position of the intake port forming section 21 of the scroll piece 2 so that a tip end portion of the shroud press fitted section 31 of the shroud piece 3 is brought into contact with the contacting portion 29 as the positioning section 39 in the axial direction as shown in FIG. 6.

The invention claimed is:

1. A compressor housing for a supercharger, which is configured to house an impeller with a plurality of blades, and includes an intake port that takes in air toward the impeller, and a discharge scroll chamber that is formed in a circumferential direction at an outer circumferential side of the impeller, and that guides the air discharged from the impeller to outside, comprising:

a scroll piece including a cylindrical intake port forming section that forms the intake port, a scroll wall surface forming section that forms an air-intake side wall surface of the discharge scroll chamber, and a scroll outer circumferential section that covers an outer circumferential side of the discharge scroll chamber;

a shroud piece including a cylindrical shroud press fitted section that is press fitted into the intake port forming section of the scroll piece, and a shroud wall surface forming section that forms an inner circumferential side wall surface of the discharge scroll chamber, and that forms a shroud surface opposing the impeller and a diffuser surface that extends from the shroud surface toward the discharge scroll chamber; and an outer circumferential annular piece including an outer circumferential annular press fitted section that is press fitted into the scroll outer circumferential section of the scroll piece, and an outer circumferential annular wall surface forming section that forms an outer circumferential side wall surface of the discharge scroll chamber, wherein the shroud piece includes a positioning section that makes contact in an axial direction with a contacting section of the scroll piece such that the outer circumferential annular piece and the scroll piece maintain a gap from one another in the axial direction.

2. The compressor housing for a supercharger according to claim 1, wherein the compressor housing is used in the supercharger in which a back plate opposing the diffuser surface of the shroud wall surface forming section of the shroud piece and a bearing housing that axially supports a rotation shaft of the impeller are integrally formed.

3. A method of manufacturing the compressor housing for a supercharger according to claim 1 or 2, the method comprising:

forming the scroll piece and an integral piece that integrally includes parts that are to be the shroud piece and the outer circumferential annular piece by die casting, respectively;

press fitting the shroud press fitted section that constitutes a part of the integral piece into the intake port forming section of the scroll piece, and press fitting the outer circumferential annular press fitted section that constitutes a part of the integral piece into the scroll outer circumferential section of the scroll piece; and cutting the integral piece subsequent to the press-fitting, and separating the integral piece into the shroud piece and the outer circumferential annular piece, wherein in the press-fitting, the positioning section, which is formed in the part of the integral piece which is to be the shroud piece, is brought into contact in an axial direction with the contacting section formed in the scroll piece such that the part of the integral piece which is to be the outer circumferential annular piece is spaced apart from the scroll piece by the gap in the axial direction.

4. The method of manufacturing the compressor housing for a supercharger according to claim 3, wherein in the press-fitting, a press-fitting fastening margin between the scroll outer circumferential section of the scroll piece and the outer circumferential annular press fitted section that constitutes the part of the integral piece is made smaller than a press-fitting fastening margin between the intake port forming section of the scroll piece and the shroud press fitted section that constitutes the part of the integral piece.

5. The compressor housing for a supercharger according to claim 1, wherein the contacting section is formed at a bottom portion of the intake port forming section of the scroll piece and the positioning section is formed at a connecting portion between the shroud press fitted section of the shroud piece and the shroud wall surface forming section.

6. The compressor housing for a supercharger according to claim 1, wherein the contacting section is formed at an axial direction intermediate position of the intake port forming section and the positioning section is formed at a tip end portion of the shroud press fitted section.

* * * * *